US008831503B2

(12) United States Patent
Hoover et al.

(10) Patent No.: US 8,831,503 B2
(45) Date of Patent: Sep. 9, 2014

(54) CREASING APPARATUS HAVING ROTATING BASE WITH RECESS

(75) Inventors: Linn C. Hoover, Webster, NY (US); Robert A. Clark, Williamson, NY (US); William J. Nowak, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 190 days.

(21) Appl. No.: 13/488,494

(22) Filed: Jun. 5, 2012

(65) Prior Publication Data

US 2013/0322947 A1 Dec. 5, 2013

(51) Int. Cl.

| | |
|---|---|
| ***G03G 15/00*** | (2006.01) |
| ***B65H 45/12*** | (2006.01) |
| ***B65H 45/30*** | (2006.01) |

(52) U.S. Cl.

USPC ..... 399/407; 439/59; 439/81; 439/356

(58) Field of Classification Search

CPC ..... B65H 45/12; B65H 45/30
USPC ..... 399/407; 493/59, 81, 356
See application file for complete search history.

(56) References Cited

U.S. PATENT DOCUMENTS

| | | | | |
|---|---|---|---|---|
| 298,425 | A | 5/1884 | Stannard | |
| 2,806,413 | A | 9/1957 | Crooke | |
| 2,856,184 | A | 10/1958 | Stobb | |
| 3,735,674 | A | 5/1973 | Haddock | |
| 6,032,004 | A | 2/2000 | Mirabella, Jr. et al. | |
| 6,840,898 | B2 * | 1/2005 | Pettersson | 493/473 |
| 6,872,177 | B1 | 3/2005 | Fullington | |
| 7,549,955 | B2 * | 6/2009 | Rathbun et al. | 493/356 |
| 7,708,680 | B2 | 5/2010 | Just et al. | |
| RE42,888 | E | 11/2011 | Crick | |
| 8,328,706 | B2 * | 12/2012 | Gombert et al. | 493/53 |
| 2003/0073556 | A1 | 4/2003 | Carbone | |
| 2004/0226645 | A1 | 11/2004 | Owen | |
| 2009/0062096 | A1 * | 3/2009 | Sasahara | 493/396 |
| 2011/0076081 | A1 | 3/2011 | Hattori | |
| 2011/0214402 | A1 * | 9/2011 | Toro | 53/574 |
| 2012/0021884 | A1 * | 1/2012 | Musha | 493/405 |

FOREIGN PATENT DOCUMENTS

| | | | | |
|---|---|---|---|---|
| JP | 2008081258 A | * | 4/2008 | B56H 45/30 |
| JP | 2011213467 A | * | 10/2011 | B65H 45/20 |

* cited by examiner

*Primary Examiner* — Nguyen Ha
(74) *Attorney, Agent, or Firm* — Gibb & Riley, LLC

(57) ABSTRACT

An apparatus includes a sheet path, an creasing member positioned on a first side of the sheet path, and a base positioned on a second side of the sheet path opposite the creasing member. The base is positioned relative to the creasing member so that a sheet of print media passes along a processing plane between the creasing member and the base when traveling in a processing direction along the media path. The processing plane is parallel to flat sides of the sheet of print media as the sheet of print media passes between the creasing member and the base. The base comprises a surface positioned parallel to the processing plane. The surface of the base has a recess having a shape corresponding to the creasing member. The surface of the base rotates in the processing plane.

20 Claims, 6 Drawing Sheets

CREASING APPARATUS HAVING ROTATING BASE WITH RECESS

BACKGROUND

Embodiments herein generally relate to devices that create creases, fold, cut, etc., sheets of print media and more particularly to devices that include a base (anvil) that has a recess where the base rotates to keep relative position to the embossing pin or wheel.

Digital printing for low volume personalized packaging is a growing market segment. The embossing action may not be adequate to weaken or stretch the paper fibers along the fold line. This can cause the top surface of the media and any image applied to that surface to crack and/or tear when the media is folded along the crease line. The crease/fold quality produced by these low cost digital cut and crease devices is a significant trade off to the crease quality of conventional vertical or rotary die cut and crease finishers.

More specifically, conventional cutters offer different folding options. The cutting knife can score the top surface of the package at the designated fold lines to weaken the media and bend at the cut to produce a straight fold. The disadvantage is the score line cuts through the image and exposes the media at the fold lines.

Alternatively, some low cost cutting and creasing finishing machines create a crease in the media by pressing a rounded pin or small beveled wheel into the top surface of the media. The opposite side of the media is supported by a thin elastomeric pad that enables the pin or wheel to emboss the media at the designated fold line. Thus, the operator can replace the knife with a scoring pen, which compresses the media against a thin pad creating a light embossing. The disadvantage here is the media deformation created by the scoring pen is very small and does not sufficiently weaken or delaminate the media at the fold lines so the folds are not crisp and straight. More specifically, this type of embossing action does not cause the media to yield, so it does not delaminate at the center when folded. The inner fibers are forced into the center of the sheet. This increases the tension in the outer fibers as the media is folded causing the fibers to tear and burst outward, which destroys the surface image along the fold line.

SUMMARY

An exemplary print media processing apparatus herein includes a sheet path, an elongated member positioned on a first side of the sheet path, and a base positioned on a second side of the sheet path opposite the elongated member. The base is positioned relative to the elongated member so that a sheet of print media passes along a processing plane between the elongated member and the base when traveling in a processing direction along the media path. The processing plane is parallel to flat sides of the sheet of print media as the sheet of print media passes between the elongated member and the base. The base comprises a surface positioned parallel to the processing plane. For example, the base can comprise a flat, planar surface or a rounded, slightly curved surface. The surface of the base has a recess having a shape corresponding to the elongated member. The surface of the base rotates in the processing plane.

Another exemplary print media processing apparatus herein includes a sheet path, an elongated member positioned on a first side of the sheet path, a base positioned on a second side of the sheet path opposite the elongated member, a first actuator connected to the elongated member, a second actuator connected to the base, and a processor operatively connected to the sheet path, the first actuator, and the second actuator.

The base is positioned relative to the elongated member so that a sheet of print media passes along a processing plane between the elongated member and the base when traveling in a processing direction along the media path. The processing plane is parallel to flat sides of the sheet of print media as the sheet of print media passes between the elongated member and the base.

The elongated member comprises, for example, an elongated cube, a wheel, a rod having a rounded end, etc. The base comprises a surface positioned parallel to the processing plane. The surface of the base has a recess having a shape corresponding to (but a mirror image of) the elongated member. Thus, the elongated member comprises, in cross-section, a structure having rounded exterior corners, and the recess comprises, in cross-section, a matching recess having rounded interior corners. The shape of the recess and elongated member cause the elongated member to delaminate interior layers of the sheet of media at a location of the crease, without breaking outer layers of the sheet of print media.

The processor controls the first actuator to move the elongated member into the recess and along the processing plane to form a crease in the sheet of print media. The processor also controls the second actuator to rotate the base in a plane parallel to the processing direction of the sheet path. Thus, the processor coordinates movement of the elongated member and the base to position the recess in the same path along which the elongated member forms the crease. The elongated member and the base rotate with each other to create a crease in any direction within the flat sides of the sheet of print media.

An exemplary printing apparatus herein includes a sheet path, and a print engine adjacent the sheet path. The print engine prints markings on a sheet of print media traveling along the sheet path. The printing apparatus further includes an elongated member positioned on a first side of the sheet path, and a base positioned on a second side of the sheet path opposite the elongated member.

The base is positioned relative to the elongated member so that a sheet of print media passes along a processing plane between the elongated member and the base when traveling in a processing direction along the media path after the sheet of print media exits the print engine. The processing plane is parallel to flat sides of the sheet of print media as the sheet of print media passes between the elongated member and the base. The base comprises a surface positioned parallel to the processing plane. The surface of the base has a recess having a shape corresponding to the elongated member. The surface of the base rotates in the processing plane.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, in conventional systems the top surface of the media and any image applied to that surface can crack and/or tear when the media is folded along the crease line. Therefore, the embodiments herein provide a movable head located on the backside of the media that tracks with the scoring probe or wheel traversing the top surface of the media. The head contains a pivoting anvil with a groove or pivoting wheel with an annular groove that minors the motion of the top scoring probe or wheel and allows the scoring implement to extrude the media into the recess or groove. This extrusion process stretches and weakens the media along the fold line allowing the bottom surface to buckle inward when the media is folded. As the bottom surface buckles in, the tension stress on the top surface is reduced which minimizes or eliminates any cracking or tearing on the top surface and corresponding printed image.

Figure 1:
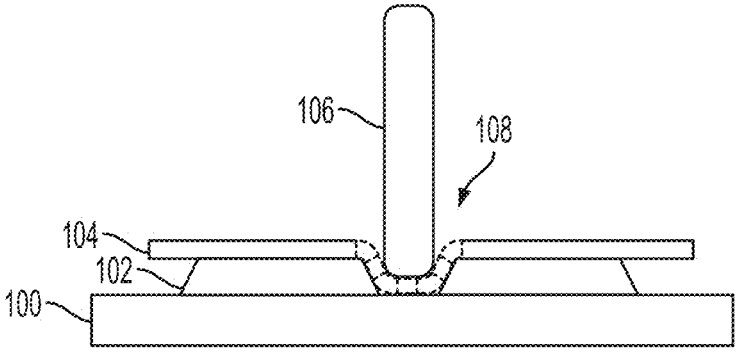
FIG. 1 is a side-view schematic diagram of a device according to embodiments herein.

As shown in FIG. 1, print media 104 is positioned over the bottom platen 100 and the die plate containing the cutting and creasing rules 106 is pressed against the platen plate 100. In FIG. 1, item 106 can represent a number of interchangeable structures including a rule, a pen, an elongated member, etc. The creasing rule 106 extrudes the media 104 into the matrix 108 creating four distinct yield points in the sheet. The media 104 is fed back and forth under the creasing rule 106 as the creasing rule 106 traverses in the cross process direction over the media 104 to fold the desired pattern. The rounded anvil 102 surface provides a smooth lead on and off transition between the anvil 102 and media 104. The width of the creasing wheel 106 and contour of the groove 108 in the anvil 102 can be increased to accommodate thicker media 104 or decreased for thinner media 104.

Figure 2:
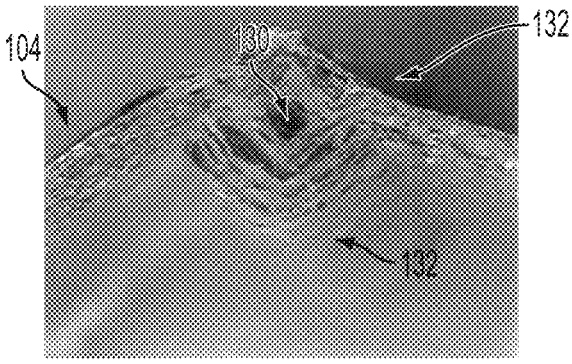
FIG. 2 is a perspective-view schematic diagram of a device according to embodiments herein.

As shown in FIG. 2, these yield points cause the media 104 to delaminate at the center of the sheet 130 resulting in the inside portion of the media 130 to buckle inward as the sheet is folded creating a small void at the center of the sheet. With over 50% of the media 104 thickness buckling inward, the tension on the outside fibers 132 is reduced as they are stretch around the fold so the fibers along the outmost layers 132 of the media 104 do not tear or otherwise disturb the surface image.

Figure 4:
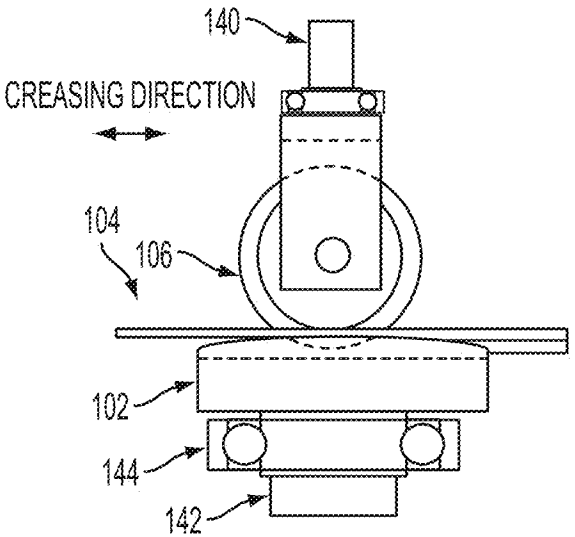
FIG. 4 is a side-view schematic diagram of a device according to embodiments herein.
Figure 3:
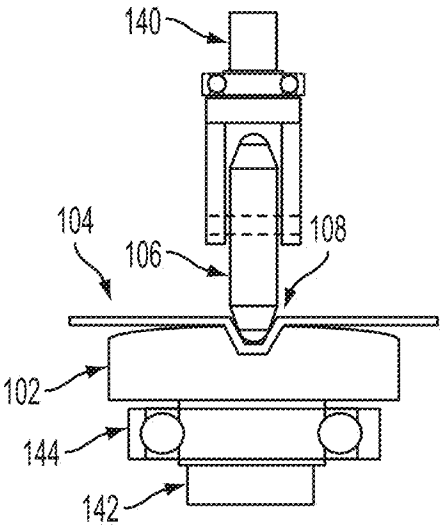
FIG. 3 is a side-view schematic diagram of a device according to embodiments herein.

FIGS. 3 and 4 show different views (end-on view (FIG. 3) and side view (FIG. 4)) of a similar structure that includes the anvil 102 with the recess and the creasing wheel 106. The creasing wheel 106 is supported by a rotating frame 140 and the anvil 102 is similarly supported by a rotating frame 142 (each of which can include ball bearings 144, for example, to assist in rotation). The rotating frame members 140, 142 allow the anvil 102 and creasing wheel 106 to each swivel on its axis to maintain alignment between the groove 108 in the anvil 102 and the creasing wheel 106 as it moves in the process, cross process or diagonal direction during creasing.

Figure 6:
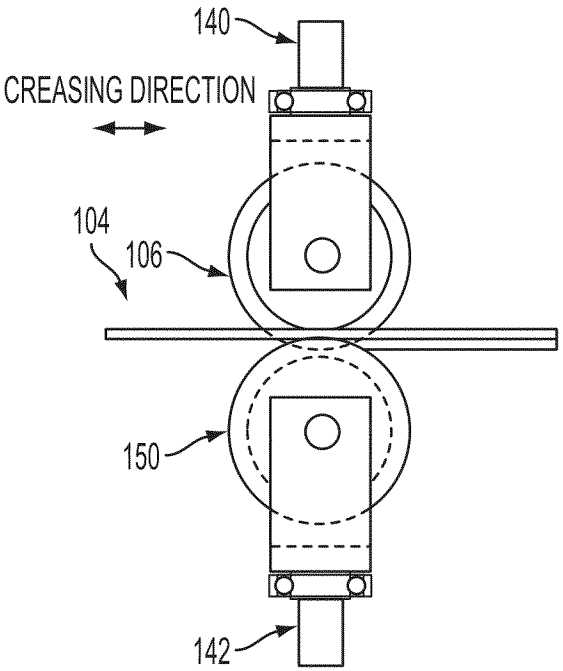
FIG. 6 is a side-view schematic diagram of a device according to embodiments herein.
Figure 5:
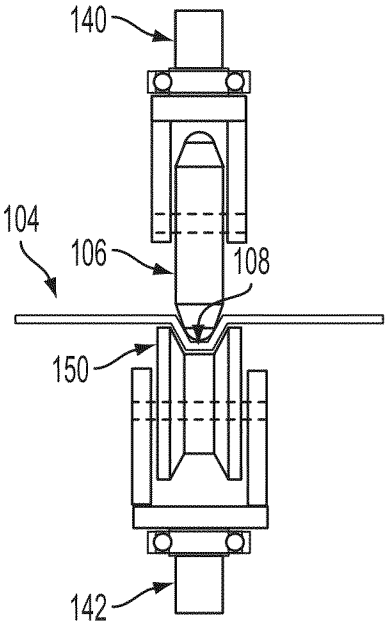
FIG. 5 is a side-view schematic diagram of a device according to embodiments herein.

FIGS. 5 and 6 similarly show end-on and side views of a similar structure that includes a concave track wheel 150 in place of the grooved anvil 102, discussed above. The shape of the concave track wheel 150 similarly provides a groove 108 and the shape of the concave track wheel 150 has a mirror image surface to the convex shape of the creasing wheel 106, such that the concave and convex surfaces work together to form a crease in the print media 104.

Figure 7:
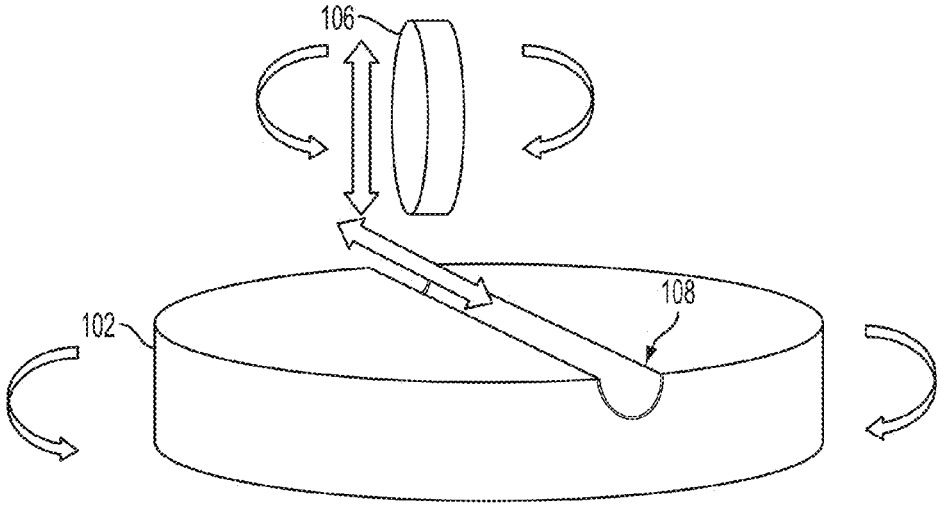
FIG. 7 is a perspective-view schematic diagram of a device according to embodiments herein.

FIG. 7 provides a simplified perspective-view schematic illustration of the groove 108 in the anvil (base) 102 and the creasing wheel 106. The curved and linear arrows in FIG. 7 demonstrate that the creasing wheel 106 and base 102 can rotate in unison and that the creasing wheel 106 can be moved toward and away from the groove 108 (as well as along the groove, as shown in the other drawings.

Figure 8:
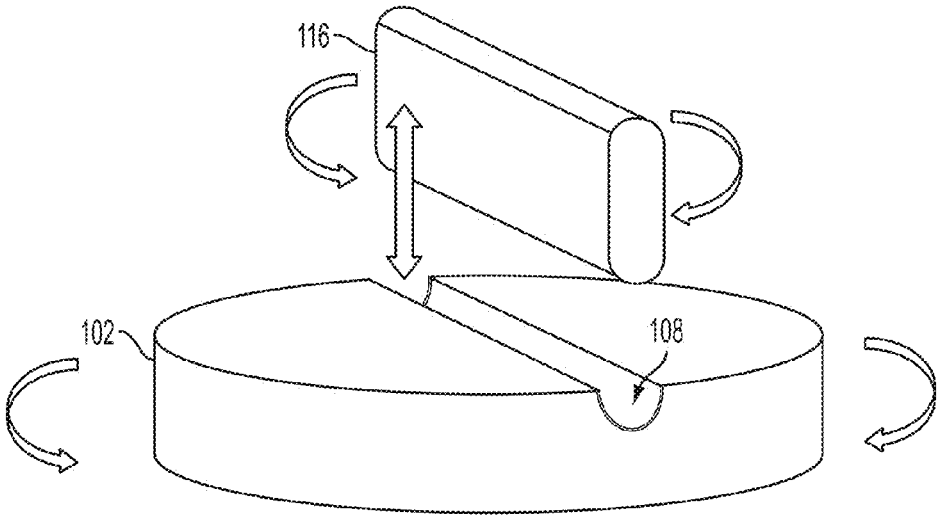
FIG. 8 is a perspective-view schematic diagram of a device according to embodiments herein.

FIG. 8 provides another simplified perspective-view schematic illustration of a structure that is similar to the structure shown in FIG. 7, except that the creasing wheel 106 is replaced with a creasing die (creasing bar) 116 that rotates in unison with the base 102. The creasing die similarly has a convex shape that fits into the groove 108 to crease the print media 104 and moves toward and away from the groove to perform the creasing action.

Figure 9:
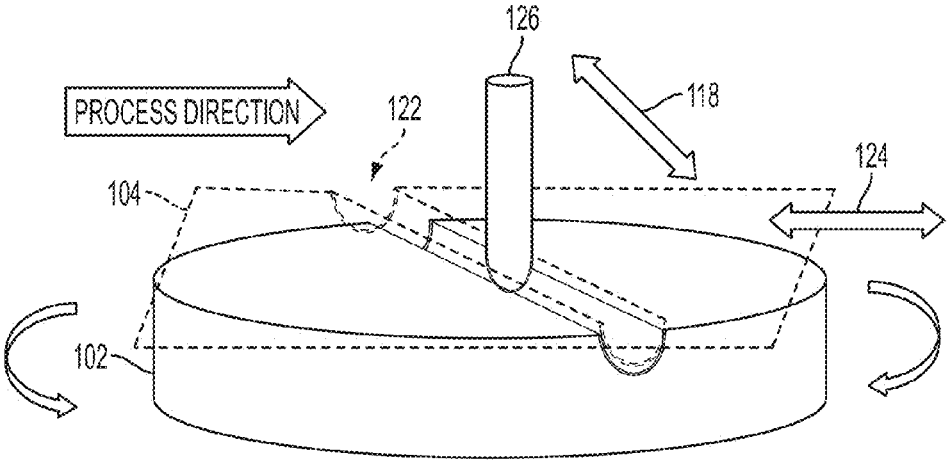
FIG. 9 is a perspective-view schematic diagram of a device according to embodiments herein.

FIG. 9 provides another simplified perspective-view schematic illustration of a structure that is similar to the structure shown in FIG. 7, except that the creasing wheel 106 is replaced with a creasing pen (creasing pin) 126 that moves in unison with the base 102 as shown by arrow 118 and the curved arrows around the base 102. The print media 104 is shown transparently in FIG. 9 to illustrate that the creasing pen 126 moves in non-parallel directions (and potentially parallel directions) to the process direction in which the print media 104 is moved to form a crease. The processing direction is also shown by double-arrow 124 in FIG. 9. The crease that is formed in the print media 104 is shown as item 122 in FIG. 9.

Figure 10:
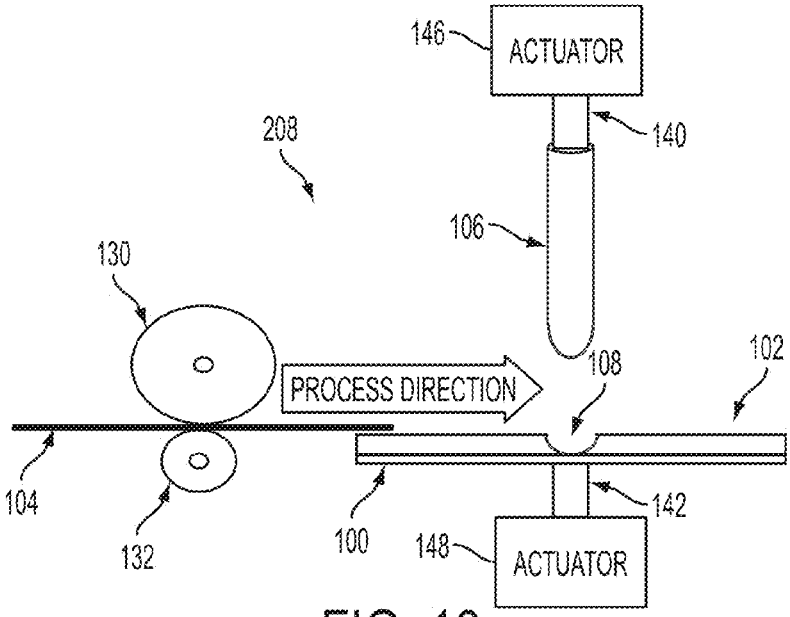
FIG. 10 is a perspective-view schematic diagram of a device according to embodiments herein.

The print media 104 is moved, for example, by driven rollers 130, 132, shown in FIG. 10. Additionally, FIG. 10 illustrates actuators 146 and 148 that can be connected to the frame members 140, 142, discussed above. The actuators 146, 148 move and rotate the creasing wheel 106, the creasing bar 116, the creasing pen 126, the base 102, and the track wheel 150 as shown by the various arrows in the drawings.

Figure 11:
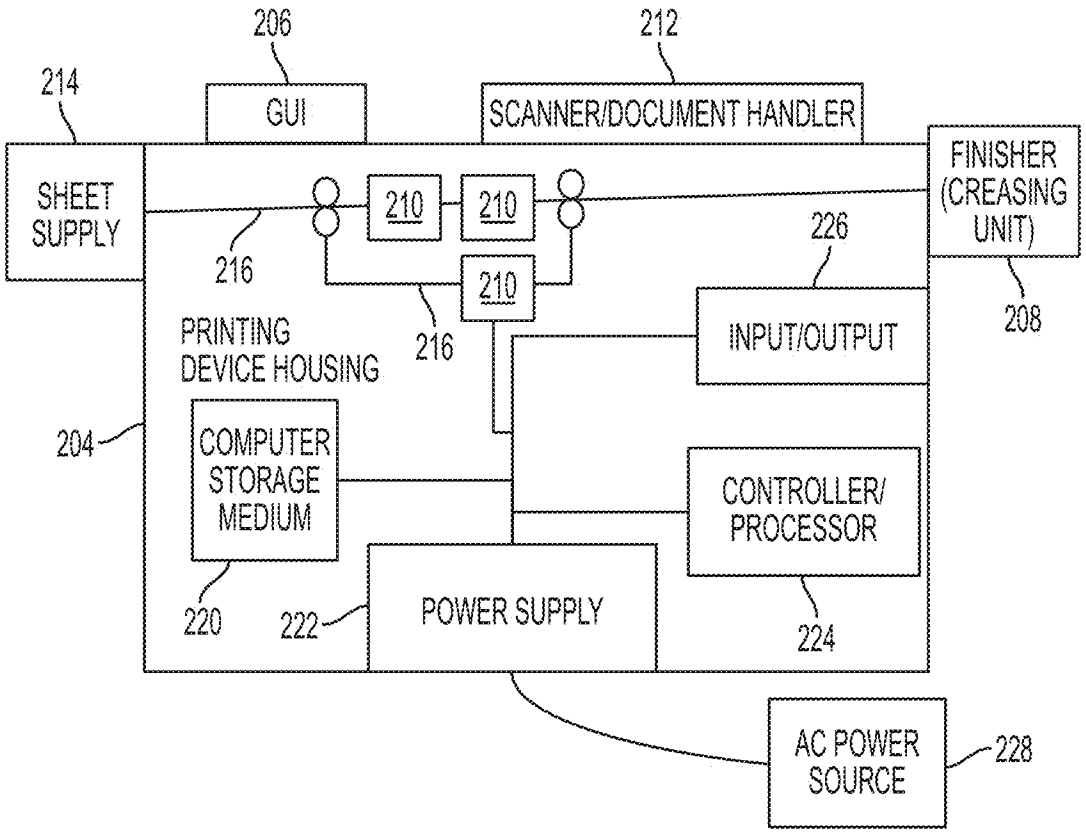
FIG. 11 is a side-view schematic diagram of a device according to embodiments herein.

FIG. 11 illustrates a computerized device 204, which can be used with embodiments herein and can comprise, for example, a printer, copier, multi-function machine, multi-function device (MFD), a print server, a personal computer, a portable computing device, etc. The computerized device 204 includes a controller/processor 224 and a communications port (input/output) 226 operatively connected to the processor 224 and to the computerized network 202 external to the computerized device 204. Also, the computerized device 204 can include at least one accessory functional component, such as a graphic user interface assembly 206 that also operate on the power supplied from the external power source 228 (through the power supply 222).

The input/output device 226 is used for communications to and from the computerized device 204. The processor 224 controls the various actions of the computerized device. A non-transitory computer storage medium device 220 (which can be optical, magnetic, capacitor based, etc.) is readable by the processor 224 and stores instructions that the processor 224 executes to allow the computerized device to perform its various functions, such as those described herein. Thus, as shown in FIG. 11, a body housing 204 has one or more functional components that operate on power supplied from the alternating current (AC) 228 by the power supply 222. The power supply 222 can comprise a power storage element (e.g., a battery) and connects to an external alternating current power source 228 and converts the external power into the type of power needed by the various components.

The computerized device 204 can also include at least one marking device (printing engines) 210 operatively connected to the processor 224, a media path 216 positioned to supply sheets of media from a sheet supply 214 to the marking device(s) 210, etc. After receiving various markings from the printing engine(s), the sheets of media can optionally pass to a finisher (creasing unit) 208 which can crease, fold, staple, sort, etc., the various printed sheets. The finisher includes the structures shown in FIGS. 1 and 3-10. Also, the printing device 204 can include at least one accessory functional component (such as a scanner/document handler 212, etc.) that also operate on the power supplied from the external power source 228 (through the power supply 222).

Thus, as shown above, an exemplary print media processing apparatus 204 herein includes a sheet path 216, an elongated member 106 positioned on a first side of the sheet path, a base 102 positioned on a second side of the sheet path opposite the elongated member 106, a first actuator 146 connected to the elongated member 106, a second actuator 148 connected to the base 102, and a processor 224 operatively connected to the sheet path 216, the first actuator 146, and the second actuator 148.

The base 102 is positioned relative to the elongated member 106 so that the sheet of print media 104 passes along a processing plane between the elongated member 106 and the base 102 when traveling in a processing direction 124 along the media 104 path. The processing plane is parallel to flat sides of the sheet of print media 104 as the sheet of print media 104 passes between the elongated member 106 and the base 102.

The elongated member 106 comprises, for example, an elongated cube (die or bar 116), a creasing wheel 106, a rod (pen or pin 126) having a rounded end, etc. The base 102 comprises a surface positioned parallel to the processing plane. For example, the base 102 can comprise a flat, planar surface or a rounded, slightly curved surface. The surface of the base 102 has a recess 108 having a shape corresponding to (but a mirror image of) the elongated member 106. Alternatively, the base can comprise a concave track wheel 150.

Thus, the elongated member 106, 116, 126 comprises, in cross-section, a rectangular convex-shape structure having rounded exterior corners, and the recess 108 comprises, in cross-section, a matching rectangular concave-shape recess 108 having rounded interior corners. The shape of the recess 108 and elongated member 106 cause the elongated member 106 to delaminate interior layers of the sheet of media 104 at a location of the crease, without breaking outer layers of the sheet of print media 104.

The processor 224 controls the first actuator 146 to move the elongated member 106 into the recess 108 and along the processing plane (in directions parallel and non-parallel to the processing direction) to form a crease in the sheet of print media 104. The processor also controls the second actuator 146 to rotate the base 102, 150 in a plane parallel to the processing direction of the sheet path. Thus, the processor coordinates movement of the elongated member 106 and the base 102, 150 to position the recess 108 in the same path along which the elongated member 106 moves to form the crease. The elongated member 106 and the base 102 rotate with each other to create a crease in any direction within the flat sides of the sheet of print media 104.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock TX, USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the embodiments herein cannot be implied or imported from any above example as limitations to any particular order, number, position, size, shape, angle, color, or material.

What is claimed is:

1. A print media processing apparatus comprising:

a sheet path;

a creasing member positioned on a first side of said sheet path; and a rounded base positioned on a second side of said sheet path opposite said creasing member, said rounded base being positioned relative to said creasing member so that a sheet of print media passes along a processing plane between said creasing member and said rounded base when traveling in a processing direction along said sheet path, said processing plane being parallel to flat sides of said sheet of print media as said sheet of print media passes between said creasing member and said rounded base, said rounded base comprising a surface positioned parallel to said processing plane, said surface of said rounded base having a recess having a shape corresponding to exterior corners of said creasing member, and said surface of said rounded base pivoting in unison with movement of said creasing member in said processing plane to position said recess in any direction in said processing plane between parallel to, and non-parallel to, said processing direction.

2. The print media processing apparatus in claim 1, said creasing member comprising, in cross-section, a structure having rounded exterior corners, and said recess comprising, in cross-section, a matching recess having rounded interior corners.

3. The print media processing apparatus in claim 1, said creasing member comprising one of an creasing cube, a wheel, and a rod.

4. The print media processing apparatus in claim 1, said creasing member and said rounded base rotating tor create a crease in any direction within said flat sides of said sheet of print media.

5. The print media processing apparatus in claim 1, said shape of said recess and said shape of said creasing member causing said creasing member to delaminate interior layers of said sheet of media at a location of said crease, without breaking outer layers of said sheet of print media.

6. A print media processing apparatus comprising:

a sheet path;

a creasing member positioned on a first side of said sheet path;

a rounded base positioned on a second side of said sheet path opposite said creasing member;

a first actuator connected to said creasing member; and a second actuator connected to said rounded base, said rounded base being positioned relative to said creasing member so that a sheet of print media passes along a processing plane between said creasing member and said rounded base when traveling in a processing direction along said sheet path, said processing plane being parallel to flat sides of said sheet of print media as said sheet of print media passes between said creasing member and said rounded base, said rounded base comprising a surface positioned parallel to said processing plane, said surface of rounded said base having a recess having a shape corresponding to said creasing member, said first actuator moving said creasing member into said recess to form a crease in said sheet of print media, and said second actuator pivoting said rounded base in unison with a movement of said creasing member to position said recess in any direction in said processing plane between parallel to, and non-parallel to, said processing direction.

7. The print media processing apparatus in claim 6, said creasing member comprising, in cross-section, a structure having rounded exterior corners, and said recess comprising, in cross-section, a matching recess having rounded interior corners.

8. The print media processing apparatus in claim 6, said creasing member comprising one of an creasing cube, a wheel, and a rod.

9. The print media processing apparatus in claim 6, said creasing member and said rounded base rotating to create a crease in any direction within said flat sides of said sheet of print media.

10. The print media processing apparatus in claim 6, said shape of said recess and said shape of said creasing member causing said creasing member to delaminate interior layers of said sheet of media at a location of said crease, without breaking outer layers of said sheet of print media.

11. A print media processing apparatus comprising:

a sheet path;

a creasing member positioned on a first side of said sheet path;

a rounded base positioned on a second side of said sheet path opposite said creasing member;

a first actuator connected to said creasing member;

a second actuator connected to said rounded base; and a processor operatively connected to said sheet path, said first actuator, and said second actuator, said rounded base being positioned relative to said creasing member so that a sheet of print media passes along a processing plane between said creasing member and said rounded base when traveling in a processing direction along said sheet path, said processing plane being parallel to flat sides of said sheet of print media as said sheet of print media passes between said creasing member and said rounded base, said rounded base comprising a surface positioned parallel to said processing plane, said surface of said rounded base having a recess having a shape corresponding to said creasing member, said processor controlling said first actuator to move said creasing member into said recess and along said processing plane to form a crease in said sheet of print media, said processor controlling said second actuator to pivot said rounded base in a plane parallel to said processing direction of said sheet path, to position said recess in any direction in said processing plane between parallel to, and non-parallel to, said processing direction.

said processor coordinating movement of said creasing member and said rounded base to position said recess in the same path along which said creasing member forms said crease.

12. The print media processing apparatus in claim 11, said creasing member comprising, in cross-section, a structure having rounded exterior corners, and said recess comprising, in cross-section, a matching recess having rounded interior corners.

13. The print media processing apparatus in claim 11, said creasing member comprising one of an creasing cube, a wheel, and a rod.

14. The print media processing apparatus in claim 11, said creasing member and said rounded base rotating to create a crease in any direction within said flat sides of said sheet of print media.

15. The print media processing apparatus in claim 11, said shape of said recess and said shape of said creasing member causing said creasing member to delaminate interior layers of said sheet of media at a location of said crease, without breaking outer layers of said sheet of print media.

16. A printing apparatus comprising:

a sheet path;

a print engine adjacent said sheet path, said print engine printing markings on a sheet of print media traveling along said sheet path;

a creasing member positioned on a first side of said sheet path; and a rounded base positioned on a second side of said sheet path opposite said creasing member, said rounded base being positioned relative to said creasing member so that a sheet of print media passes along a processing plane between said creasing member and said rounded base when traveling in a processing direction along said sheet path after said sheet of print media exits said print engine, said processing plane being parallel to flat sides of said sheet of print media as said sheet of print media passes between said creasing member and said rounded base, said rounded base comprising a surface positioned parallel to said processing plane, said surface of said rounded base having a recess having a shape corresponding to said creasing member, and said surface of said rounded base pivoting in unison with movement said creasing member in said processing plane to position said recess in any direction in said processing plane between parallel to, and non-parallel to, said processing direction.

17. The printing apparatus in claim 16, said creasing member comprising, in cross-section, a structure having rounded exterior corners, and said recess comprising, in cross-section, a matching recess having rounded interior corners.

18. The printing apparatus in claim 16, said creasing member comprising one of an creasing cube, a wheel, and a rod.

19. The printing apparatus in claim 16, said creasing member and said rounded base rotating to create a crease in any direction within said flat sides of said sheet of print media.

20. The printing apparatus in claim 19, said shape of said recess and said shape of said creasing member causing said creasing member to delaminate interior layers of said sheet of media at a location of said crease, without breaking outer layers of said sheet of print media.

* * * * *